US005890460A

United States Patent [19]

Ball et al.

[11] Patent Number: 5,890,460

[45] **Date of Patent: *Apr. 6, 1999**

[54] ELECTRICAL GENERATOR SET

[76] Inventors: Ronald C. Ball, 3639 Haven Ave., Menlo Park, Calif. 94025; William A. Eldredge, P.O. Box 5457, Redwood City, Calif. 94063

[ * ] Notice: The term of this patent shall not extend beyond the expiration date of Pat. No. 5,694,889.

[21] Appl. No.: 863,836

[22] Filed: May 27, 1997

Related U.S. Application Data

[63] Continuation-in-part of Ser. No. 593,248, Jan. 29, 1996, Pat. No. 5,694,889, which is a continuation-in-part of Ser. No. 436,768, May 8, 1995, Pat. No. 5,515,816.

[51] Int. Cl.[6] ..... F01P 1/02

[52] U.S. Cl. ..... 123/41.7; 123/2; 123/41.63; 123/41.65; 290/1 B

[58] Field of Search ..... 123/41.7, 41.63, 123/41.65, 2; 290/1 A, 1 B

[56] References Cited

U.S. PATENT DOCUMENTS

| | | | |
|---|---|---|---|
| 4,548,164 | 10/1985 | Ylönen et al. | 123/2 |
| 4,647,835 | 3/1987 | Fujikawa et al. | 322/1 |
| 4,835,405 | 5/1989 | Clancey et al. | 290/1 A |
| 5,121,715 | 6/1992 | Nogami et al. | 123/41.7 |
| 5,433,175 | 7/1995 | Hughes et al. | 123/2 |
| 5,515,816 | 5/1996 | Ball et al. | 123/41.7 |
| 5,575,349 | 11/1996 | Ikeda et al. | 180/68.1 |
| 5,694,889 | 12/1997 | Ball et al. | 123/41.7 |

*Primary Examiner*—Henry C. Yuen
*Assistant Examiner*—Hai Huynh
*Attorney, Agent, or Firm*—Paul F. Schenck

[57] ABSTRACT

The electrical generator set has two separate cooling airflows. A first airflow is generated by an impeller mounted on the drive shaft of the engine and provides for cooling the electrical generator or alternator and for partial cooling of the electrical circuitry which controls mainly the voltage of the electrical output. This airflow exists only while the engine is running. The first airflow is mixed with the exhaust gases of the internal combustion engine for noise and temperature reduction. the use of a venturi tube supports driven by the exhaust gases supports the airflow.

A second airflow provides for cooling the radiator of the liquid cooled internal combustion engine and for partial cooling for the electrical circuitry. This second airflow is generated by one or more electrical fans and is independent on whether or not the engine is running.

12 Claims, 9 Drawing Sheets

ELECTRICAL GENERATOR SET

This is a continuation-in-part application of U.S. Pat. No. 5,694,889, issued Dec. 9, 1997, which is a continuation-in-part application of U.S. patent Ser. No. 436,768, filed May 8, 1995 now U.S. Pat. No. 5,515,816, issued May 14, 1996.

BACKGROUND OF THE INVENTION

The present invention relates to motor-generator sets for generating electrical energy. The present invention provides for a very compact implementation with low noise level. A first design offers a low profile package with easy access to all components, thereby providing very easy maintainability. A second design includes an open package with a high efficiency electrical generator.

SHORT DESCRIPTION OF THE INVENTION

In the first implementation of the present invention a small air-cooled horizontally mounted diesel engine is used to drive an electrical generator via a coupling. The enclosure includes several cooling air intakes, hot air and exhaust air outlets. In the second implementation a small liquid cooled vertically mounted engine is used to drive an electrical generator via a coupling. The airflow direction pattern is divided to supply sufficient and dedicated cooling air to the various components. By separating the various airflows noise normally connected with high speed airflow is reduced. Surrounding the exhaust of the engine by used cooling air reduces the temperature of the exhaust fumes.

In still another airflow pattern one independent airflow is used to cool the driving internal combustion engine. Another independent airflow is used to cool the electrical generator. Both the airflows are used to cool the electronic controlling operation of the electrical generator set and to convert the generated electrical energy to one or more voltages, e.g. 120 VAC and 12 VDC.

OBJECTS OF THE INVENTION

It is another object of the invention to provide for a multi-airflow cooling system in electrical generator sets.

It is another object of the invention to provide for a quiet sound-reducing electrical generator set.

It is still another object of the invention to provide for a cooling system which is partially independent of the speed of the driving engine.

SHORT DESCRIPTION OF THE FIGURES

DESCRIPTION OF THE FIRST PREFERRED EMBODIMENT

Figure 1:
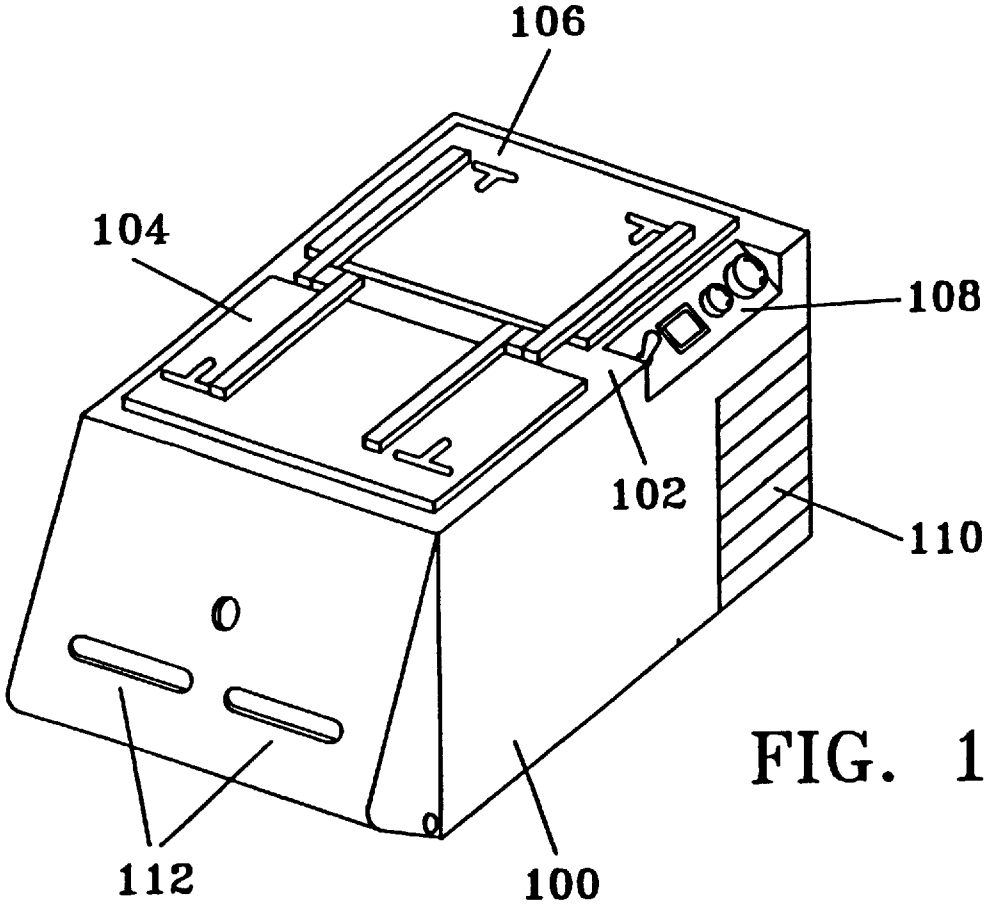
FIG. 1 is an illustration of a Diesel engine driven generator set of the present invention.

FIG. 1 is an illustration of a Diesel engine driven generator set of the present invention. The enclosure of the generator set includes uni-body section 100 with a cover 102 having two lids 104 and 106. A control panel 108 is provided to operate the generator set without having to open lids 104 and 106. Uni-body section 100 has an air intake opening 110 and second air intake openings 112. Air entering the generator set through opening w10 is used to cool the cylinder of the engine which drives the electrical generator and for cooling the electrical generator, as will be disclosed in detail with reference to FIG. 3. A part of the same intake air is used by the engine itself. Second air intakes 112 provide cooling air for the general interior, including the oil pan of the driving engine. If required, these openings 112 may provide also cooling air for a separate oil cooler of the driving engine inside uni-body 100.

In the preferred embodiment cover 102 is attached to uni-body by screws in a conventional manner. Cover 102 includes a center spar to which the hinges of lids 104 and 106 are linked. The ends of the center spar are affixed to opposing side walls of enclosure 100. The center spar is of sufficient strength so that a lifting hook may be attached for moving the generator set.

Figure 2:
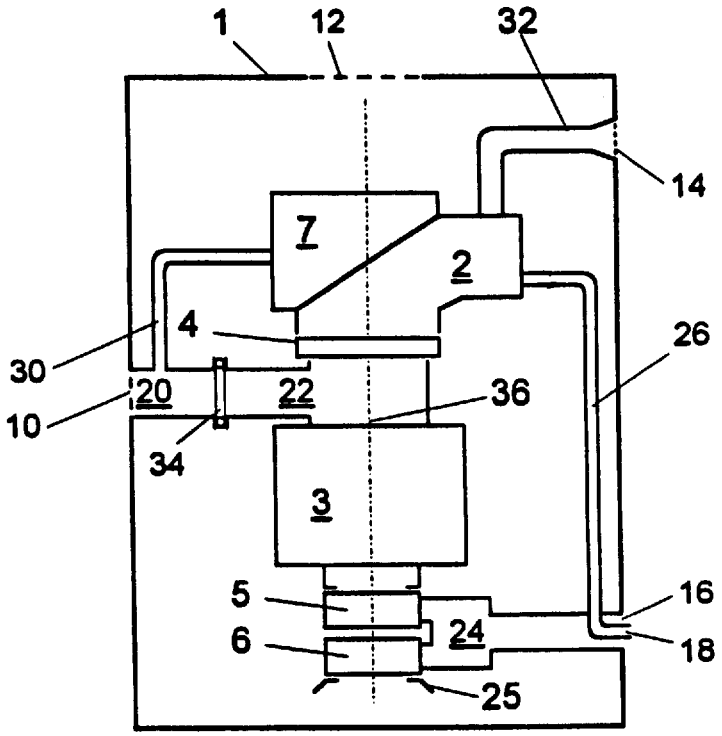
FIG. 2 is a schematic illustration of diesel engine 7 driven generator set of the present invention.

FIG. 2 is a schematic illustration of the airflow distribution in the system of the present invention. The diesel generator set of the present invention is mounted inside a main enclosure 1. The Set consists of a flat diesel engine 7, partially enclosed in a shroud 2, coupled to an electrical generator enclosed in a generator enclosure 3. Shroud 2 guides a cooling airflow to the cylinder of diesel engine 7. Reference 36 relates to the common axis of the drive shaft of the internal combustion engine and the shaft of the electrical generator. A first air blower 4, which is a flywheel with appropriate blower blades, is mounted on the drive shaft of diesel engine 7 inside shroud 2. A second air blower 5 and a third air blower 6 are mounted on the free end of the shaft of the electrical generator inside generator enclosure 3. Second air blower 5 and third air blower 6 are radial type blowers and are mounted back to back, which allows to deliver air from two different sources into the same chamber 24, i. e. from inside of generator enclosure 3 and from the interior of main enclosure 1 but outside of shroud 2 and generator enclosure 3. Blower 5 controls the airflow through generator enclosure 3. Blower 6 has a shroud 25 as an intake means and moves air from the interior of enclosure 1 to mixing chamber 24. The combined airflows of blowers 5 and 6 exit via pipe 16 to outside of enclosure 1. The cooling air of diesel engine 7 enters chamber 20 through opening 10, moves into chamber 22. Cooling air in chamber 22 is separated into an airflow for cooling diesel engine 7 and an airflow for cooling the electrical generator covered by enclosure 3. The cooling air for diesel engine 7 inside shroud 2 is accelerated by axial blower 4 and exits via pipe 32 through a separate opening 14 in enclosure 1. Diesel engine 7 receives combustion air for operation from chamber 20 via pipe 30. Exhaust fumes are passing through pipe 26 to the outside of enclosure 1. However, pipe 26 is led into cooling air outlet 16 so that the hot diesel exhaust fumes exiting from free end 18 of pipe 26 are enveloped by cooler air of outlet 16. This combined outlet for cooling air and diesel exhaust fumes reduces the temperature of the exhaust fumes and reduces the speed differential between the diesel exhaust fumes and the air outside enclosure 1, thereby reducing also the noise level.

Third air blower 6 draws air from the inside of main enclosure 1. This air enters the inside of main enclosure through an intake 12 and flows around the crankshaft case, the oil pan of engine 7 and shroud 2 cooling parts of diesel engine 7, and generator enclosure 3. Passing through blower 6, which has an intake shroud 25, this third airflow 66 joins the cooling airflow from the electrical generator in plenum chamber 24. At the location where exhaust pipe 26 enters pipe 16 cooling air from blowers 5 and 6 envelops pipe 26. Outside enclosure 1 cooling air exiting at opening 16 envelops exhaust fumes exiting from exhaust pipe opening 18.

Figure 3:
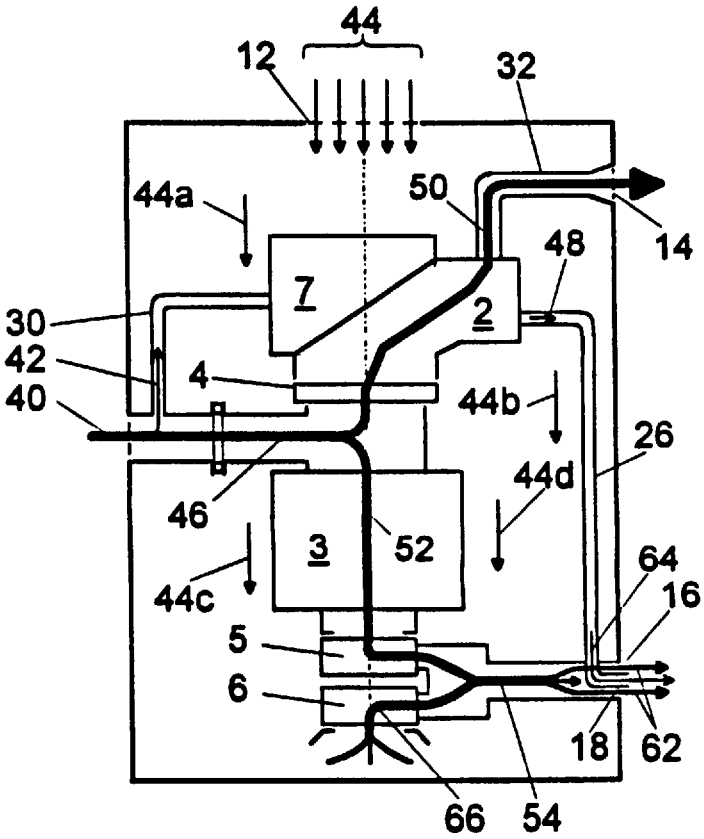
FIG. 3 is a schematic illustration of the airflow distribution in the system of the present invention.

FIG. 3 is a schematic illustration of the airflow of the generator set. There are three major airflows. The first airflow 50 is used to cool the cylinder walls of the internal combustion engine inside shroud 2. The second airflow 52 is used to cool the generator inside generator enclosure 3. First and second airflows are derived from the same airflow 46, which enters the main enclosure as airflow 40. Airflow 40 also includes the supply of combustion air 42 needed by the combustion engine 7. The amount of throughput of first airflow 50 and second airflow 52 is mainly determined by the selection of first blower 4 and second blower 5 and the airflow obstructions in the paths of these airflows.

The third air blower 6 generates airflow 66 from the inside of main enclosure 1. The air of airflow 66 enters the inside of main enclosure 1 through intake 12 as airflow 44 and flows around the crankshaft case, the oil pan of engine 7 and shroud 2 cooling parts of diesel engine 7, and generator enclosure 3 as indicated by arrows 44*a* through 44*d*. Passing through blower 6 this third airflow 66 joins the cooling airflow 52 from the electrical generator in plenum chamber 24. At the location where exhaust pipe 26 enters pipe 16 the combined airflow 54 from blowers 5 and 6 envelops pipe 26 as airflows 62. Outside enclosure 1 cooling air exiting from opening 16 envelops exhaust fumes 64 exiting from exhaust pipe opening 18. Exhaust fumes 48 of diesel engine 7 are already cooled by airflow 62 in flow area 64 before the fumes are released.

Engine 7 may have an additional oil cooler mounted closely against a wall of main enclosure 1. This oil cooler may include a separate air blower. Cooling air for the oil cooler can be diverted from airflow 44 and released through an separate opening to the outside of main enclosure 1. The additional cooling airflow for the oil cooler would reduce the thermal load on airflows 44*a* through 44*d* and increase the total number of airflows to four.

Figure 4:
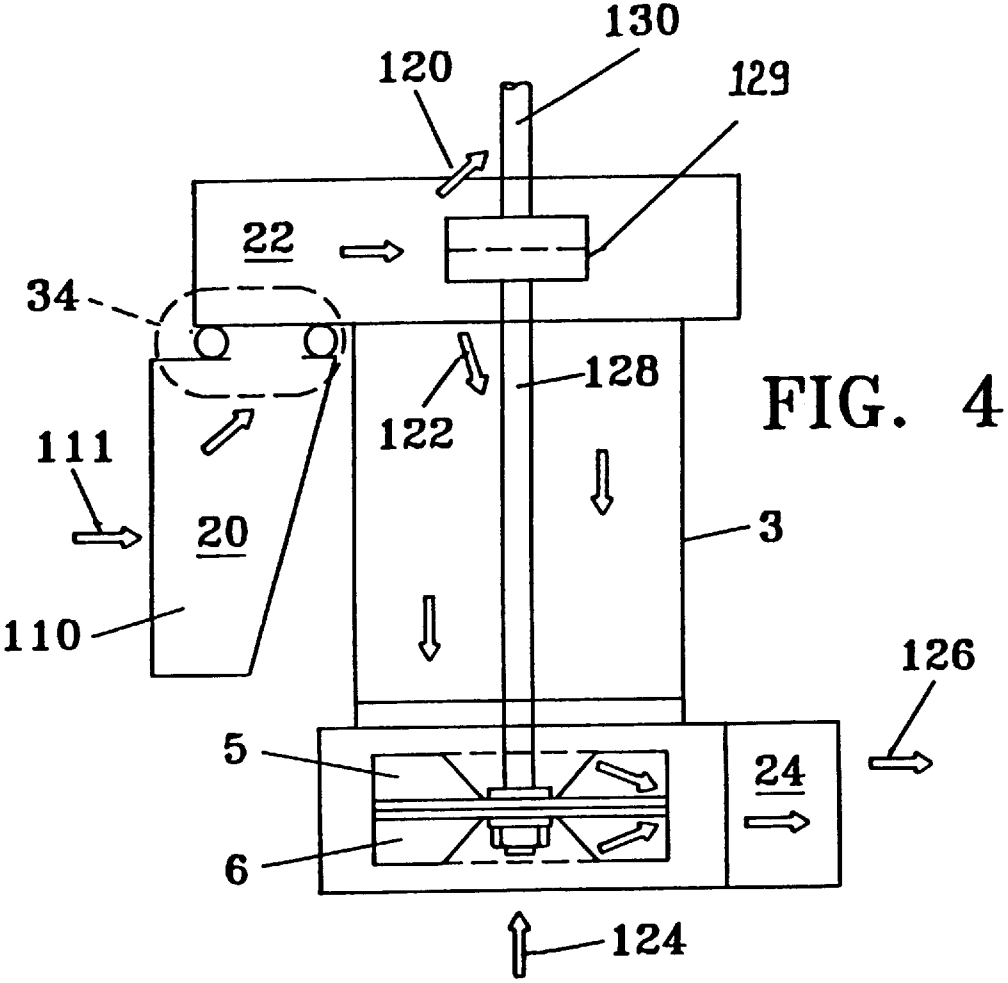
FIG. 4 is another schematic illustration of the dual air-blower unit used for mixing cooling air of the electrical generator and the general internal cooling air of the unit.

FIG. 4 is another schematic illustration of the dual air-blower unit used for mixing cooling air of the electrical generator and the general internal cooling air of the unit. Air 111 entering the generator set through intake 110 is collected in chamber 20, which is affixed to uni-body 100 (FIG. 1). The air is then entering chamber 22. Chamber 22 is affixed to the combination of engine 7 and generator enclosure 8. Chambers 20 and 22 have an interface 34 which allows near air-tight relative movement between chambers 22 and 24. In chamber 22 cooling air is split into one airflow 120 which cools the cylinder wall of the driving engine and a second cooling airflow 122 for cooling the electrical generator inside shroud 3. An air blower 5 control airflow 122 and accelerates the air cooling the electrical generator into mixing chamber 24. Air blower 6 collects cooling air 124 from the interior of uni-body 100 and accelerates this air into mixing chamber 24. Air of the combined cooling airflow 126 leaves uni-body 100 through opening 16.

As shown in FIG. 4 air blowers 5 and 6 are mounted on the free end of shaft 128 of the electrical generator inside enclosure 3. This shaft is coupled to drive shaft 130 of the driving engine by coupling 129. In FIGS. 2 and 3 these shafts are represented by common axis 36.

The use of a flat engine in combination of a direct coupled electrical generator and the use of a plurality of appropriately dimensioned cooling airflows allows to reduce the overall size of the space required for the generator set and thereby reducing the size of the main enclosure, especially the height of the main enclosure.

While the specification of the first preferred embodiment discloses a diesel generator set, it is considered to be within the skills of the common practitioner to select an internal combustion engine of a different type to drive the generator without departing from the spirit of the present invention.

DESCRIPTION OF THE SECOND PREFERRED EMBODIMENT

Figure 5:
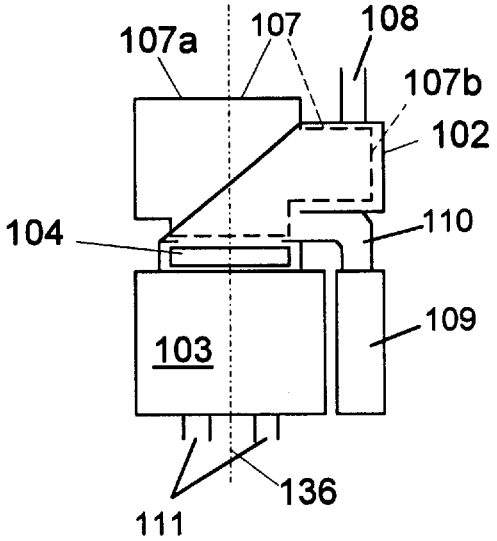
FIG. 5 is a schematic illustration of a first embodiment of an electrical generator set with a single air blower and multiple airflow cooling system using an air cooled internal combustion engine.
Figure 6:
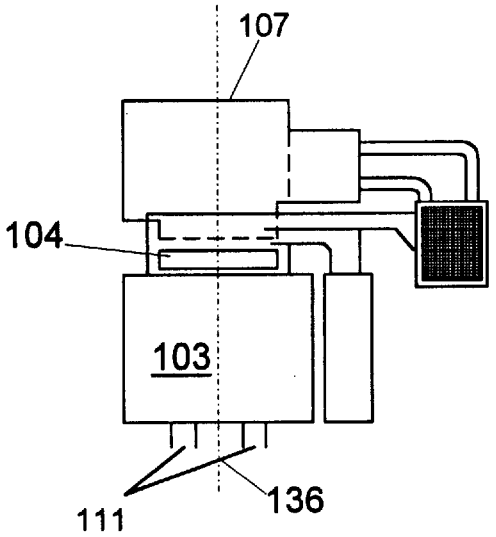
FIG. 6 is a schematic illustration of a first embodiment of an electrical generator set with a single air blower and a multiple air flow cooling system using a water cooled internal combustion engine.

FIG. 5 is a schematic illustration of a generator set using an air cooled internal combustion engine 207 to drive a high efficiency electrical generator 203. Engine 207 and generator 203 are directly coupled. Line 236 represents the axes of the driving shaft of engine 207 and the driven shaft of generator 203. An air blower wheel 204 is mounted either on the driving shaft of engine 207 or on the driven shaft of generator 203, thus is positioned on the same axis 236. This blower wheel is functioning as a flywheel and has fans for generating an axially directed forced air flow. Engine 207 may be a diesel engine, as disclosed in the earlier section of this specification or an air cooled engine using other conventional means for ignition of a combustible fuel mixture. To control the flow of the forced air around the cylinder the cylinder head is encapsuled by a shroud 202 which guides a part of the forced air towards cylinder head 207*b*. Cooling fins of cylinder head 207*b* then guide the cooling air towards air exit 208 of shroud 202.

Electrical generator 203 is a high efficiency alternator type which supplies alternating current to an electronic section in enclosure 209. The electronic section transforms the supplied alternating current into a stabilized alternating current with a desired voltage and/or a stabilized direct current with a desired voltage. For cooling the electronic section a part of the forced air flow is diverted by a separate air duct 210 and passes through enclosure 209.

Electrical generator 203 has a rotor with permanent magnets and openings for passing cooling air through the rotor. The stator of the electrical generator carries the electrical windings and includes sufficient openings to let cooling air pass through. Two openings 211 in the bearing shield of electrical generator 203 (far side from the driving engine 207) allows air to enter electrical generator 203. This air flow is caused by the suction of air blower wheel 204. The suction capability has to provide sufficient air to cool cylinder head 202 of engine 207 and to cool the electronic section in enclosure 209.

Figure 7:
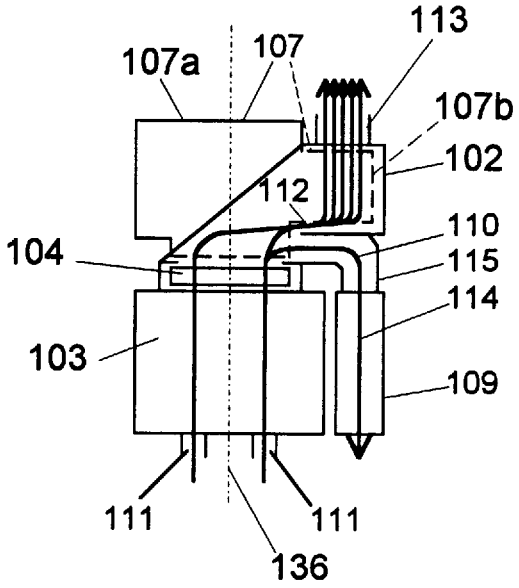
FIGS. 7 and 8 are schematic illustrations showing the air flow stream of the generator sets of FIGS. 5 and 6, respectively.

FIG. 7 is a schematic illustration of the air flow in an arrangement just disclosed with respect to FIG. 5. Air entering generator 203 through openings 211 forms inside generator 203 a combined air flow through the stator and through the rotor of generator 203. This combined air flow passes through blower wheel 204 and is split into a first air flow 212 which is guided by shroud 202 towards cylinder head, where it is split by the cooling fins of cylinder head 207*b* into a plurality of parallel air flows, which leave shroud 202 through opening 213.

The second air flow 214 is guided by air duct 210 into enclosure 209 and exiting enclosure 209 after passing over the electronic section.

Figure 8:
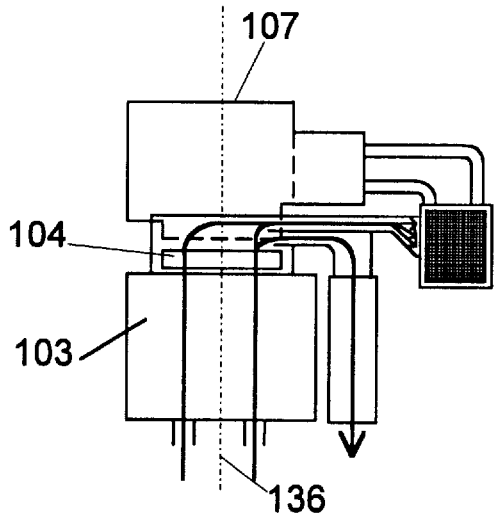

FIG. 8 is a schematic illustration of the cooling air flow of a generator set using a liquid coolant for cooling the cylinder head of the driving engine. The cylinder head 207*c* includes channels for passing the coolant from an input port to an output port, to which there is connected a radiator 220 using hoses or pipes 221. A coolant pump may be interconnected in this circulation system, however for simplification it is not included in the schematic illustrations. A part 222 of the airflow 223 which passed through the electrical generator 203 and fan 204 is guided to radiator 220 to assist in cooling the coolant. Another part 224 of airflow 223 is guided by air duct 225 into enclosure 209 and exiting enclosure 209 after passing over the electronic section.

Figure 9:
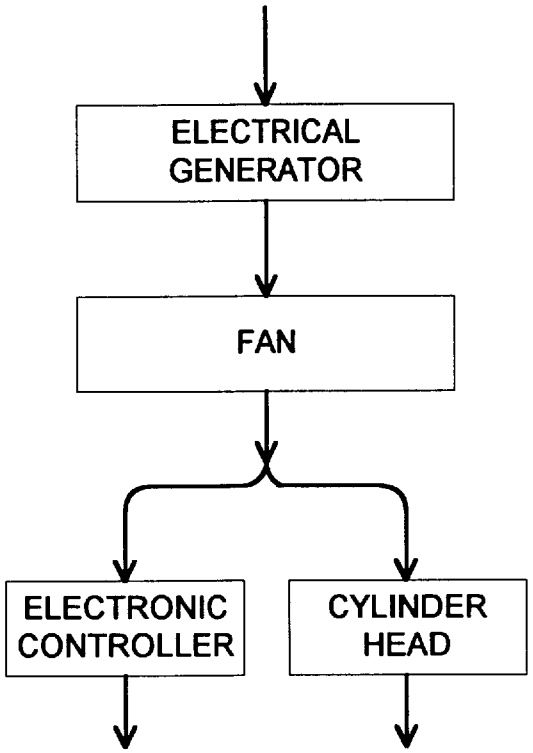
FIGS. 9 and 10 are schematic illustrations of the cooling arrangement of the second preferred embodiment.
Figure 10:
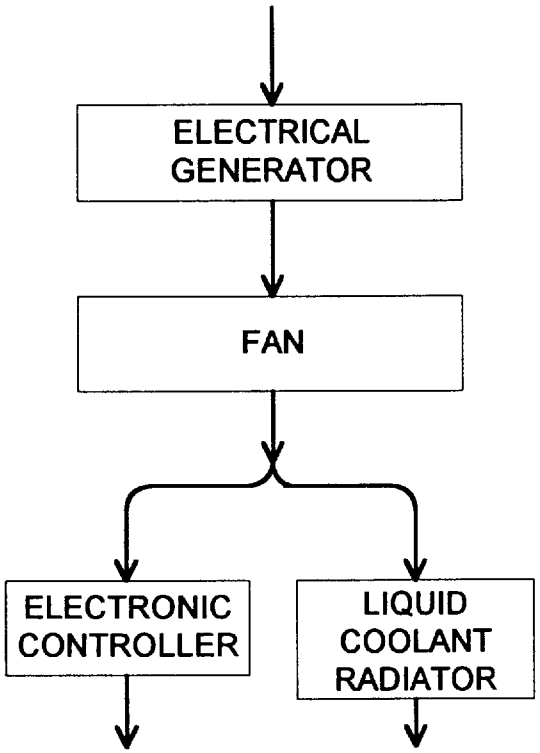

FIGS. 9 and 10 are schematic illustrations of the cooling arrangements of the second preferred embodiments of the present invention. FIG. 9 related to a generator set using an air cooled engine, FIG. 10 relates to a generator set using a liquid coolant engine. The two arrangement differ in the direct cooling of the cylinder head by a part of the forced air flow versus the use of a part of the forced airflow for indirect cooling using a liquid coolant as intermediate transfer medium. The arrangement of the present invention provides for easy adaptability to the required cooling of the engine. The air cooled cylinder head is used in low power applications, the liquid coolant cylinder head is used for higher power requirements. All major components remain unchanged.

The use of a universal alternator and an electronic controller for transforming the alternating current produced by the alternator into the required type of electric power allows to adapt the generator set to the particular application. E.G., in an application as an emergency power unit it could serve as a 120 VAC power source with a battery charging facility at 12 VDC, or even as an emergency starter for cars.

DESCRIPTION OF THE THIRD PREFERRED EMBODIMENT

Figure 11:
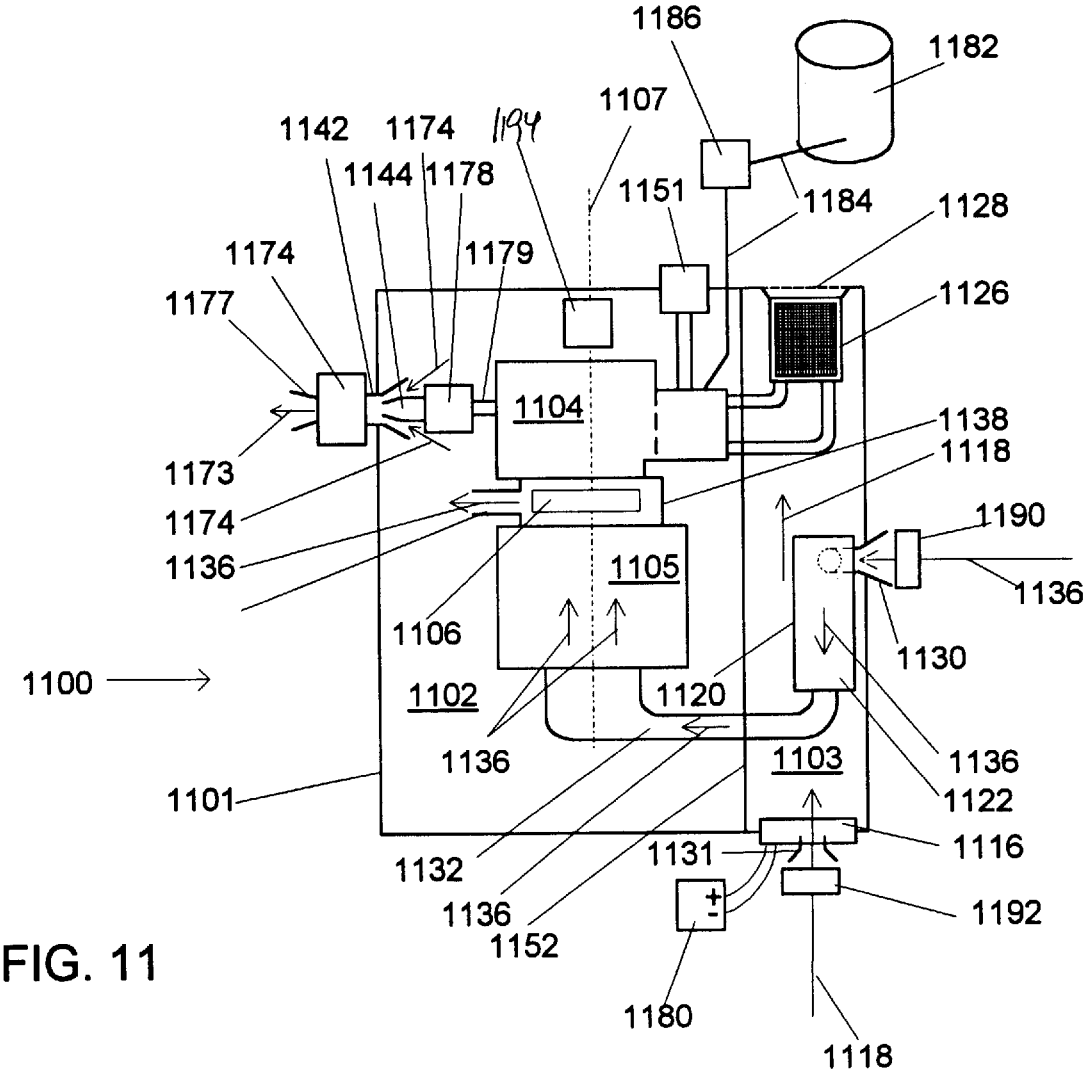
FIGS. 11 and 12 are schematic illustrations of the cooling arrangement of the third preferred embodiment.

FIG. 11 is a schematic illustration of the layout of a third embodiment of the present invention and the airflow pattern inside the enclosed electrical generator set. The electrical generator set 1100 has an enclosure 1101, which is internally divided by a separation wall 1152 into a section 1102 and a section 1103. Major components located in section 1102 are internal combustion engine 1104, alternator 1105 and airflow generating impeller 1106 in shroud 1138 for generating a first air flow 1136, which is identified in FIG. 11 by several arrows 1136. Major parts in section 1103 are one or more fans 1116 for generating a second air flow 1118, enclosure 1122 containing the electronic circuitry for of the electrical generator set 1100 including the output voltage or voltages, and cooling radiator 1126 of combustion engine 1104.

As illustrated in FIG. 11 internal combustion engine 1104 is directly coupled to alternator 1105, which generates electrical energy at a voltage convenient for transformation to one or more different voltages. An impeller 1106 is mounted on the drive shaft of engine 1104 which drives alternator 1105. (In FIG. 11, the axis of the drive shaft of engine 1104 is represented by dotted line 1107.) Impeller 1106 is surrounded by shroud 1138 suitably shaped to generate first airflow 1136 from intake 1130, through box 1122, duct 1132, alternator 1105 into the space of section 1102 of enclosure 1101.

One or more electrical fans 1116 are mounted in one of the walls of section 1103 of enclosure 1101. Fans 1116 generate second airflow 1118 which first passes from intake 1131 along external side 1120 of electronic box 1122, providing one cooling airflow 1118 for the electronic circuitry inside box 1122. (The other cooling air flow is airflow 1136.) Airflow 1118 is then directed to pass through radiator 1126 and leaves enclosure 1101 through baffle 1128.

Engine 1104 receives air for the combustion through air intake 1151. Exhaust gases of engine 1104 are passed through a first muffler 1178, the center pipe 1144 of a venturi device, where it is mixed with air 1174 of the first cooling air flow 1136, through a second muffler 1172 which is external to enclosure 1101. Mixture 1173 of exhaust gases and cooling air of first air flow 1136 are then released to the open air at pipe 1177. The rush of the exhaust gases through center pipe 1144 provides a suction for removing air out of section 1102 of enclosure 1101 (see arrows 1174 indicating the air flow), thereby supporting the first air flow generated by impeller 1106. The arrangement of the venturi device and the intake of air from section 1102 are arranged in such a manner, that most of the air under suction passes near or over the outside surface of first muffler 1178. The suction is generated by the exhaust gases exiting first muffler 1178 and rushing through center pipe 1144 into the larger pipe 1142 of the venturi device. First muffler 1178 receives the exhaust gases of engine 1104 from exhaust pipe 1179. The use of second muffler 1172 provides for additional cooling of the exhaust gases and for reducing exhaust noise.

Electrical fan or fans 1116 for generating second airflow 1118 provide for cooling of electronic box 1122 even when engine 1104 is not running. Under such a condition, an external source of electricity or a local battery 1180 is used to operate the fan or fans. If two or more fans are used, it may be advantageous to provide for fans with different electrical voltage specification, so that at least one fan can be operated from an external source, e.g. 120 VAC or 12 VDC, the other fan can be operated by the electricity generated by alternator 1104.

To provide for extended hours of operation electrical generator set 1100 may be equipped with an external tank connection 1184 to external tank 1182 in addition to a smaller local tank attached to or included in the enclosure of the electric generator set. The external tank connection may also include an electric pump 1186 to control fuel flow from the external tank.

Electrical generator set 1100 can be mounted on a sled or have a support structure including opening for tongues of a forklift, thereby ease transportation and positioning. The openings for the tongues of a forklift can serve as air supply channels for combustion air of engine 1104 and for first airflow 1136. These air supply channels can be equipped with air filters to reduce air contamination by dust particle. In such a case air intakes 1130 and 1151 would receive such filtered air.

To provide additional start capabilities for the electrical generator set, a starter motor 1194 can be mounted on the drive shaft with axis 1107. Starter motor 1194 could be used in combination with battery 1180 to start electrical generator set 1100.

Figure 12:
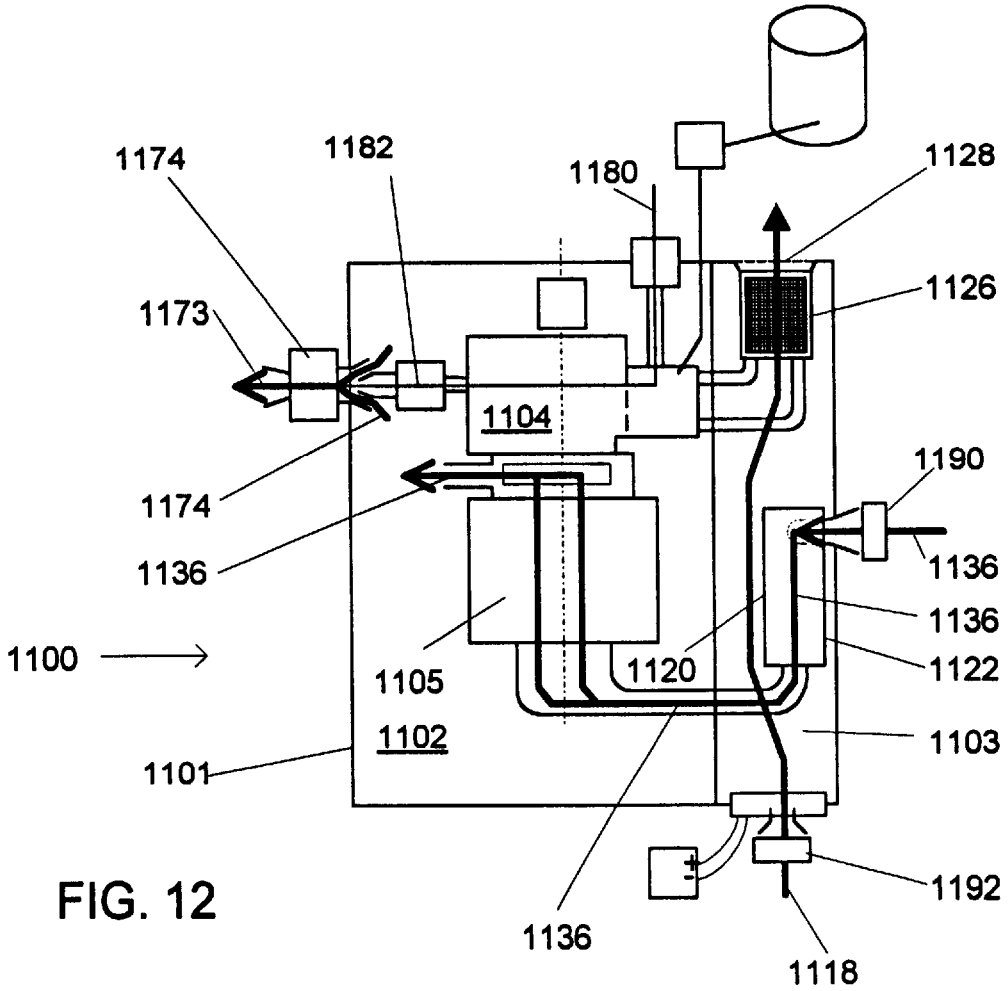

FIG. 12 is a schematic illustration to show the two airflows 1136 and 1118 inside the enclosure of electrical generator set 1100.

First airflow 1136 is directed through box 1120 which contains electronic circuitry, cools alternator 1105, enters the space of section 1102, is mixed with exhaust 1182 of engine 1104 and leaves electrical generator set 1100 through muffler 1174.

Second airflow 1118 enters the space of section 1103, cools at least one side of electronic box 1122 from the outside, passes through radiator 1126 and leaves electrical generator set 1100 through baffle 1128.

The two airflows ensure that the electronic circuitry in box 1122 can be cooled even when engine 1104 is not running. Furthermore, after shutdown of engine 1104, second airflow 1118 passes through radiator 1126 and reduces the temperature of the cooling fluid of engine 1104. When engine 1104 is running and the electronic circuitry generates more heat, then the first airflow provides the needed additional cooling air.

If engine 1104 is an air cooled type engine, then the cylinder block of the engine should extend into section 1103 of enclosure 1101 to achieve the same effect.

It is considered within the skills of the artisan in this field of technology to use diesel engines, gasoline engines, four-stroke- or two-stroke type of engines.

What is claimed is:

1. An electrical generator set comprising an enclosure having a first and a second section, separated by a separation wall;

a liquid cooled internal combustion engine having a radiator for cooling a cooling liquid and a drive shaft, an electrical generator linked to said drive shaft for providing electrical energy at a first voltage, an electronic circuitry for converting said electrical energy of said first voltage to at least one desired second voltage, said electronic circuitry being enclosed in a electronic box with a heat sink connected to an outside of said box;

an impeller mounted on said drive shaft of said engine inside a shroud for generating a first air flow;

an airflow path for guiding said first airflow from an air intake through said electronic box, through a duct connecting said electronic box to a front side of said alternator, through said alternator and said airflow generating impeller into said first section of said enclosure and through an air exit out of said enclosure;

at least one fan mounted in an outside wall of said second section of said enclosure for generating a second airflow flowing from said at least one fan along an outside of said side of said electronic box through said radiator and leaving said second section through a baffle in another outside wall of said second section of said enclosure;

said radiator being located in said second section connected by hoses to said liquid cooled internal combustion engine in said first section;

whereby said electronic circuitry inside said electronic box is cooled by said first airflow while said combustion engine is running and by said second airflow while said at least one fan is operating.

2. An electrical motor generator set as claimed in claim 1, further including a battery for storing electrical energy, said battery being connected to at least one of said at least one fan for generating said second airflow.

3. An electrical generator set as claimed in claim 1, whereby said electrical generator set includes at least two fans, of which a first fan is operated from a voltage generated by said alternator, and a second fan is operated from a second electrical energy source for generating said second airflow, thereby providing said second airflow independent of said internal combustion engine being operated.

4. An electrical generator set as claimed in claim 1, further including a battery for storing electrical energy, said battery being connected to a starter motor for starting said internal combustion engine.

5. An electrical generator set as claimed in claim 2, further including a fuel pump for supplying fuel from a tank external to said enclosure to said internal combustion engine.

6. An electrical generator set as claimed in claim 1, wherein said air exit includes a venturi suction tube having a center tube, a suction intake and a gas exit, said center tube receiving exhaust gases from said internal combustion engine and providing a suction at said suction intake, said suction intake receiving air from said first section of said enclosure, said gas exit feeding a mixture of said exhaust gases and said air from said first section to an outside of said enclosure, thereby cooling said exhaust gases.

7. An electrical generator set as claimed in claim 6, wherein said air exit further includes a first muffler located inside said first section of said enclosure and connected between said internal combustion engine and said center tube of said venturi suction tube for noise reduction.

8. An electrical generator set as claimed in claim 7, further includes a second muffler located external to said enclosure and connected to said gas exit for further noise reduction.

9. An electrical generator set as claimed in claim 1, further including air filters at said intake baffle and said at least one fan for filtering air of said first and second air flow.

10. An electrical generator set as claimed in claim 9, wherein said enclosure includes a support structure having pockets for receiving tongues of a forklift, and wherein said intake baffle of said first airflow receives air from one of said pockets, and wherein at least on of said air filters is located at or in said one of said pockets.

11. An electrical generator set comprising an internal combustion engine, means for cooling said engine, a generator for electrical energy driven by said internal combustion engine and providing said electrical energy at a first voltage, electrical circuitry for converting said electrical energy from said first voltage to at least one second voltage, a first airflow for cooling said electrical circuitry and said generator, a second airflow for cooling said electrical circuitry and said means for cooling said engine;

whereby said first airflow depends on said engine being operating, and wherein said second airflow depends upon a source of electrical energy.

12. An electrical generator set as claimed in claim 11, wherein said internal combustion engine includes an exhaust gas port providing exhaust gases, said generator set further including a venturi tube driven by said exhaust gases and supporting said first airflow, whereby said exhaust gases are cooled.

* * * * *